US008220305B2

(12) United States Patent
Böcking

(10) Patent No.: US 8,220,305 B2
(45) Date of Patent: Jul. 17, 2012

(54) DEVICE FOR GUIDING A METAL STRIP AND METHOD FOR OPERATING IT

(75) Inventor: Reinhard Böcking, Kreuztal (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 960 days.

(21) Appl. No.: 12/085,415

(22) PCT Filed: Oct. 25, 2007

(86) PCT No.: PCT/EP2007/009248

§ 371 (c)(1),
(2), (4) Date: Jun. 30, 2008

(87) PCT Pub. No.: WO2008/061601

PCT Pub. Date: May 29, 2008

(65) Prior Publication Data

US 2010/0212386 A1 Aug. 26, 2010

(30) Foreign Application Priority Data

| | | |
|---|---|---|
| Nov. 24, 2006 | (DE) | 10 2006 055 954 |
| Jan. 18, 2007 | (DE) | 10 2007 002 805 |
| Mar. 31, 2007 | (DE) | 10 2007 015 636 |

(51) Int. Cl.
*B21D 5/08* (2006.01)
*B21C 47/00* (2006.01)

(52) U.S. Cl. ..... 72/176; 72/148

(58) Field of Classification Search ..... 72/133, 72/142, 145, 148, 176, 250, 252
See application file for complete search history.

(56) References Cited

U.S. PATENT DOCUMENTS

| | | | | |
|---|---|---|---|---|
| 3,228,225 | A * | 1/1966 | Hiegel | 72/148 |
| 5,009,092 | A * | 4/1991 | Buchegger | 72/148 |
| 7,155,950 | B2 * | 1/2007 | Dommel et al. | 72/148 |

FOREIGN PATENT DOCUMENTS

| | | |
|---|---|---|
| DE | 16 02 348 | 10/1970 |
| DE | 26 45 451 | 4/1978 |
| DE | 28 48 044 | 5/1980 |
| EP | 0 249 543 | 12/1987 |
| EP | 0 909 596 | 4/1999 |

* cited by examiner

*Primary Examiner* — Teresa M Ekiert
(74) *Attorney, Agent, or Firm* — Lucas & Mercanti, LLP; Klaus P. Stoffel

(57) ABSTRACT

A device and method for guiding a metal strip in the vicinity of a coiler. The device includes a support frame, which at its first end is rotatably supported about a second axis of rotation relative to a fixed structure and supports a guide table and at its second end, i.e., the end that lies opposite the first end, is rotatably connected with a swivel frame about a first axis of rotation. The swivel arm supports a first guide table at its end that lies opposite the first axis of rotation. Both the support frame and the swivel frame are controlled by their own associated actuators and are suitably positioned according to the desired operating position.

8 Claims, 6 Drawing Sheets

DEVICE FOR GUIDING A METAL STRIP AND METHOD FOR OPERATING IT

BACKGROUND OF THE INVENTION

The invention concerns a device for guiding a metal strip in the vicinity of a coiler and a method for operating it.

Coilers and devices for guiding a metal strip in their vicinity are basically well known in the prior art, e.g., from patent DE 28 48 044 C2. In this patent, a device of this type comprises a swivel arm, which is supported at a first end in such a way that it can rotate about a first axis of rotation and supports a guide table at a second end, i.e., the end opposite the first end. A coil-opening chisel is mounted on the guide table. An actuator is provided for swiveling the swivel frame together with the guide table and the chisel about the first axis of rotation.

SUMMARY OF THE INVENTION

Proceeding from this prior art, the objective of the invention is to further develop a device for guiding a metal strip in the vicinity of a coiler and a method for operating a device of this type in such a way that the device can be more universally adjusted in that it can be moved into more operating states than is possible with the previously known prior-art device.

This object is characterized by the fact that, in addition, a support frame is provided, with a first end on which the support frame is rotatably supported about a second axis of rotation relative to a fixed structure and supports a second guide table and with a second end on which the support frame is rotatably supported about the first axis of rotation and is connected with the first end of the swivel frame, and that a second actuator is provided, which is rotatably supported on both the fixed structure and the support frame for swiveling the support frame about the second axis of rotation.

The desired universal adjustability is realized by providing the swiveling support frame, which supports the swivel frame with the first guide table. The claimed device can then not only be used for opening coils of different sizes on a coiler and moved into a parking position, but it can also be used to bridge a coiler, especially a reversing coiler, by guiding a metal strip over this coiler, and it can also be used to insert the metal strip in a belt wrapper. All of the specified operating states can preferably be realized by simple adaptation of traditionally used hydraulic and electric systems and controls. In addition, the claimed device has the advantage that it needs very little room in the direction of conveyance of the strip, especially in its parking position. This compact construction is especially advantageous when the claimed device is used on the left and right side of a reversing mill, because when it is used in this way, the distances between the reversing coilers and the reversing mill can be minimized. The smaller these distances are, the smaller the portion of the metal strip that must be cut off as scrap at the end of a reversing mill operation.

It is advantageous for both the swivel frame and the support frame to be designed with a U-shape. They each consist of a crosshead in the form of a guide table, which extends transversely to the direction of conveyance of the strip and of two legs positioned parallel to each other on both sides and transverse to the guide tables.

To realize a "clamping slot" operating position, the device preferably has a carriage, which can be linearly displaced relative to a first guide table, which is supported by the swivel frame. The carriage supports a coil-opening chisel, hereinafter also referred to simply as a chisel, and preferably a third guide table, which ends flush with the surface of the chisel.

With the aid of a third actuator, the chisel with the third guide table, which preferably makes a comb-like transition into or mates in comb-like fashion with the first guide table, can be moved into the immediate vicinity of a clamping slot on the mandrel of the coiler in order to guide the metal strip there.

The actuators are preferably designed as hydraulic cylinders.

The device preferably has a guide pulley that is rotatably supported about the second axis of rotation for deflecting the metal strip when the strip is being wound onto or unwound from the coiler.

The objective of the invention with respect to a method is achieved by a method for operating the device of the invention. In accordance with this method, the device can be moved selectively into one of the operating positions, namely, clamping slot, parking position, strip guidance over the coil, coil opening, or belt wrapper. The advantage of this method is the aforementioned great universal adjustability of the device of the invention.

The specification is accompanied by six drawings.

DETAILED DESCRIPTION OF THE INVENTION

Figure 1:
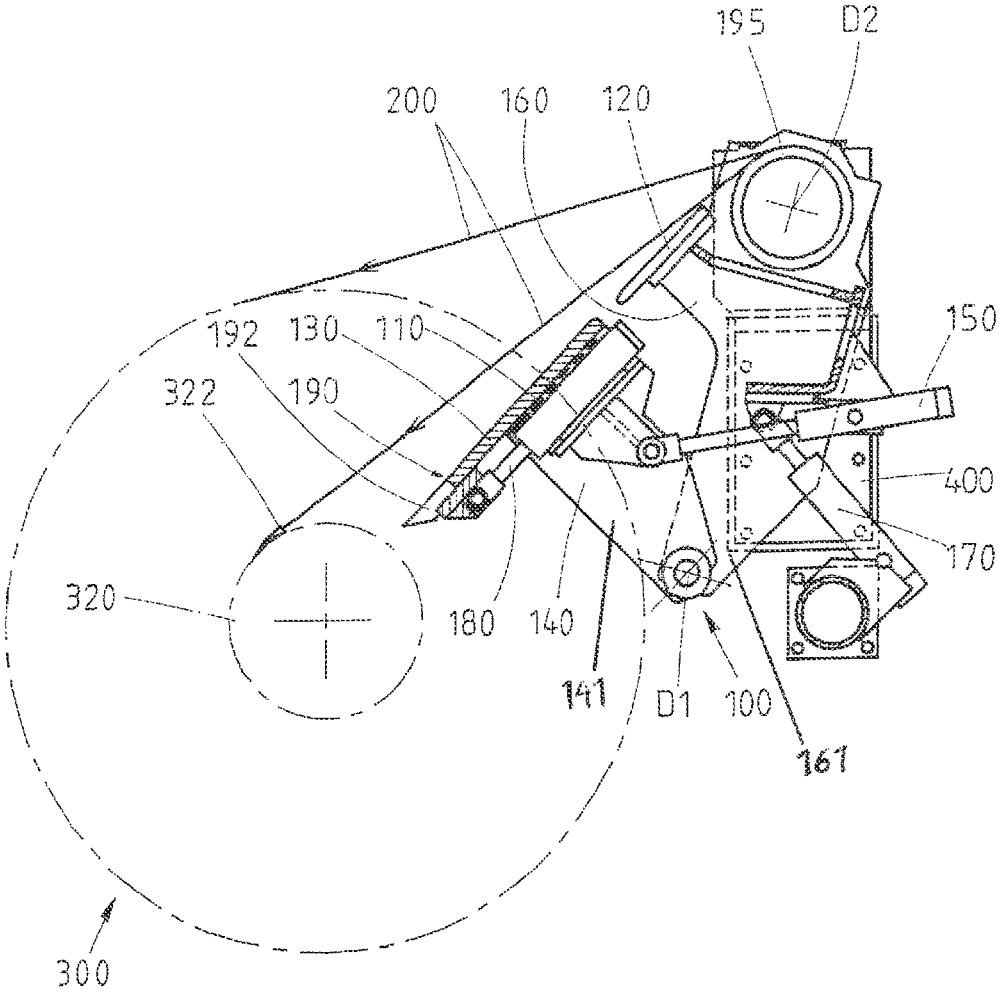
FIG. 1 shows the device of the invention in a "clamping slot" operating position.

The invention is described in detail below with respect to the specific embodiments shown in the drawings. In all of the drawings, mechanical elements that are the same are designated with the same reference numbers. Arrows in the drawings (other than the arrows on reference numbers) show the direction of conveyance of the metal strip in each case.

FIG. 1 shows a side view of the device of the invention 100 in the operating position "moving into the clamping slot". The device 100 is arranged laterally next to a coiler 300 and is used to insert a metal strip 200, which is coming from a guide pulley 195, into a clamping slot 322 on the mandrel 320 of the coiler 300. The device comprises a support frame 160, which has a first end that is rotatably supported about a second axis of rotation D2 relative to a fixed structure 400. In the area of its first end, the support frame 160 supports a second guide table 120. At its second end, which lies opposite its first end, the support frame 160 is rotatably connected with a swivel frame 140 about a first axis of rotation D1. The support frame 160 is pivoted about the axis of rotation D2 by means of a second actuator 170, which is rotatably supported on both the fixed structure 400 and the support frame 160.

The support frame supports the swivel frame 140 at its first end. At the second end of the swivel frame, which lies opposite the first end of the swivel frame, the swivel frame supports a first guide table 110. The swivel frame, together with the guide table, can be swiveled about the first axis of rotation D1 by means of a first actuator 150.

The swivel frame 140 is U-shaped with a crosshead formed by the first guide table 110, and has two parallel legs 141.

Only one leg is shown in the side view of the drawings. The support frame 160 is also U-shaped with a crosshead formed by the second guide table 120, and has two parallel legs 161. Only one leg is shown in the side view of the drawings.

In addition, the device has a carriage, which is displaceably supported relative to the swivel frame 140. The carriage comprises a chisel 192 and preferably a third guide table 130, which ends flush with the surface of the chisel.

The displacement of the carriage relative to the swivel frame 140 and especially relative to the first guide table 110 is effected by means of a third actuator 180. The carriage is displaced linearly relative to the swivel frame and preferably in such a way that the surfaces of the second and third guide tables 120, 130 remain lying in one plane in each displaced position.

Preferably, at least one of the actuators 150, 170, or 180 is realized as a hydraulic cylinder.

Figure 2:
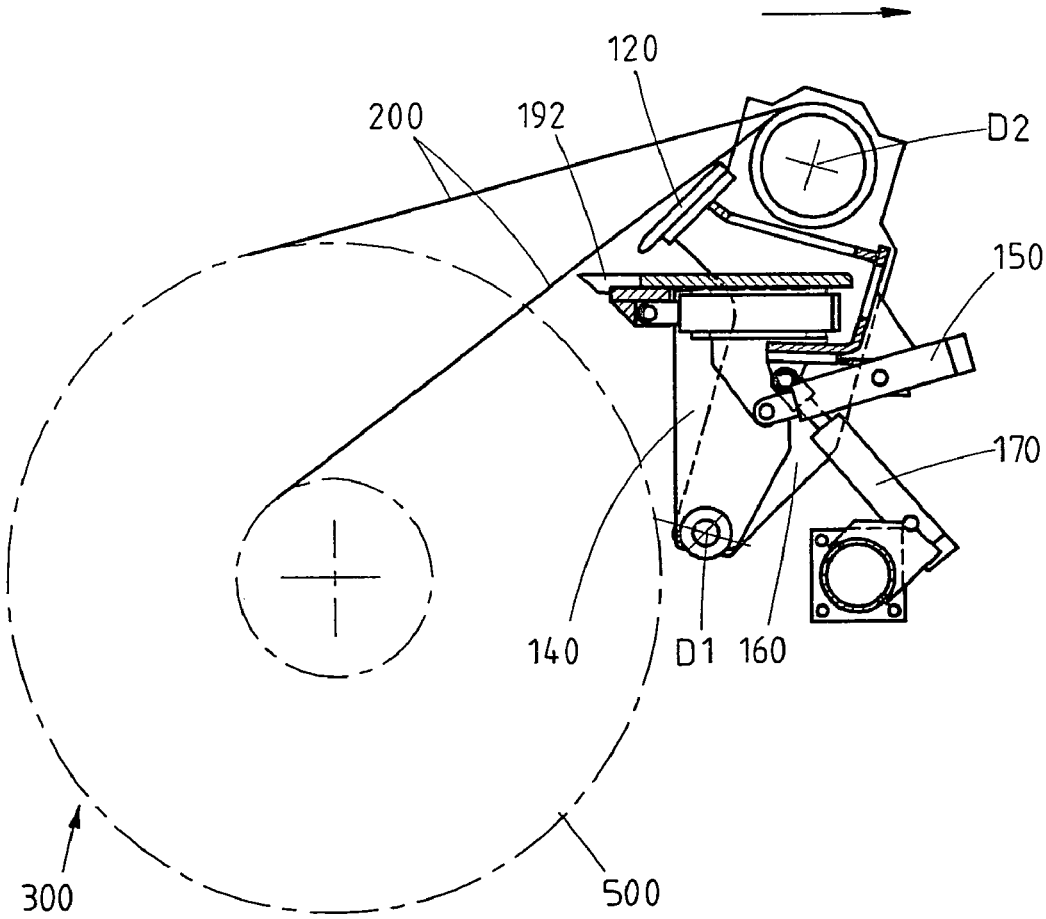
FIG. 2 shows the device of the invention in a parking position.

FIG. 2 show the device of the invention in the operating position "parking position". In this parking position, the carriage 190 is retracted, and the swivel frame 140 with the first guide table 110 and the carriage is swung in, so that the device of the invention has only a minimal space requirement in the horizontal direction, i.e., in the direction of conveyance of the metal strip 200. The device is preferably swung in in such a way that it is supported, i.e., as seen in the plane of the drawing, completely outside of a metal coil 200, which is wound on the coiler and is indicated by the circular dot-dash line. The parking position has the advantage that it allows the wound metal coil to be moved out of the line without any problems, i.e., transversely to the direction of strip conveyance. In this respect, the device of the invention does not get in the way in the parking position.

Figure 3:
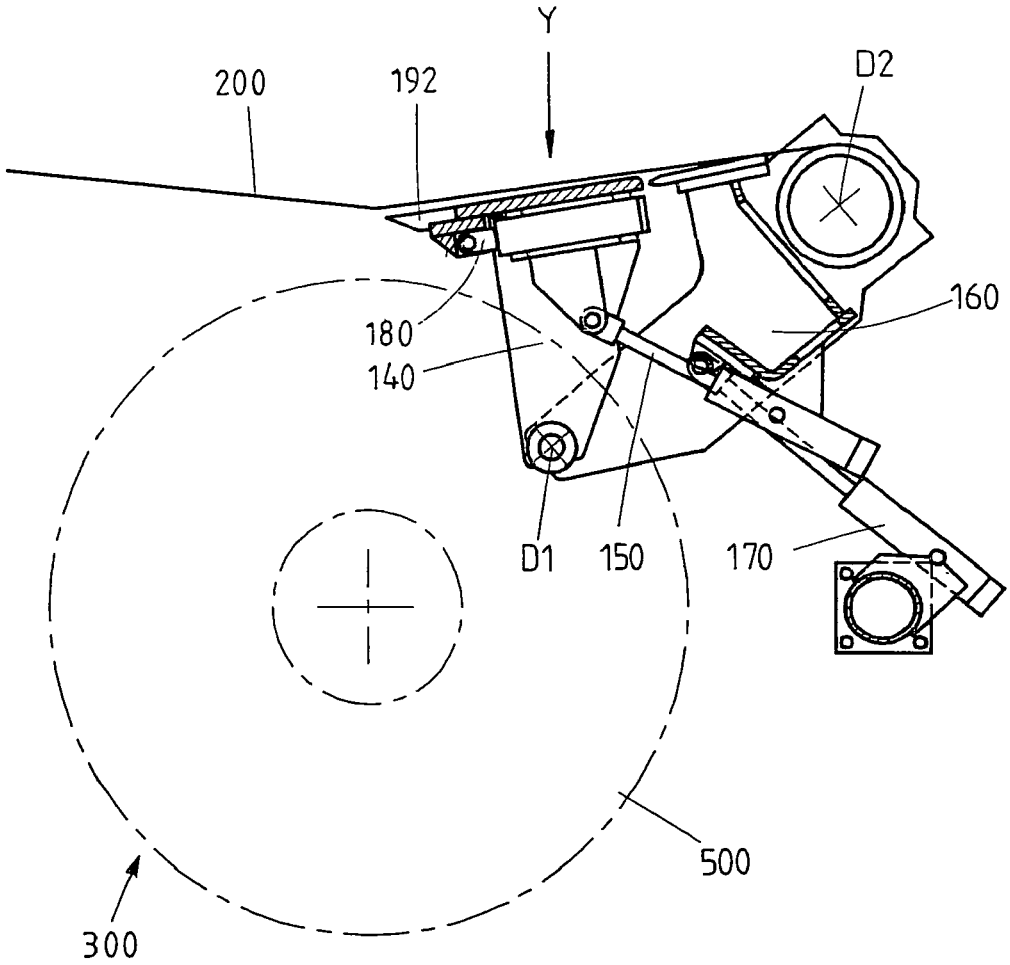
FIG. 3 shows the device of the invention in the position "strip guidance over the coil".

FIG. 3 shows the device of the invention in the operating position "strip guidance over the coil". The purpose of this operating position is to guide the metal strip 200 safely over, e.g., the coiler 300 or a wound coil 500. For this purpose, the device is controlled by the actuators 150, 170, 180 in such a way that the first, second, and/or third guide table reliably supports the metal strip 200 as it is guided over the metal coil 500.

Figure 4:
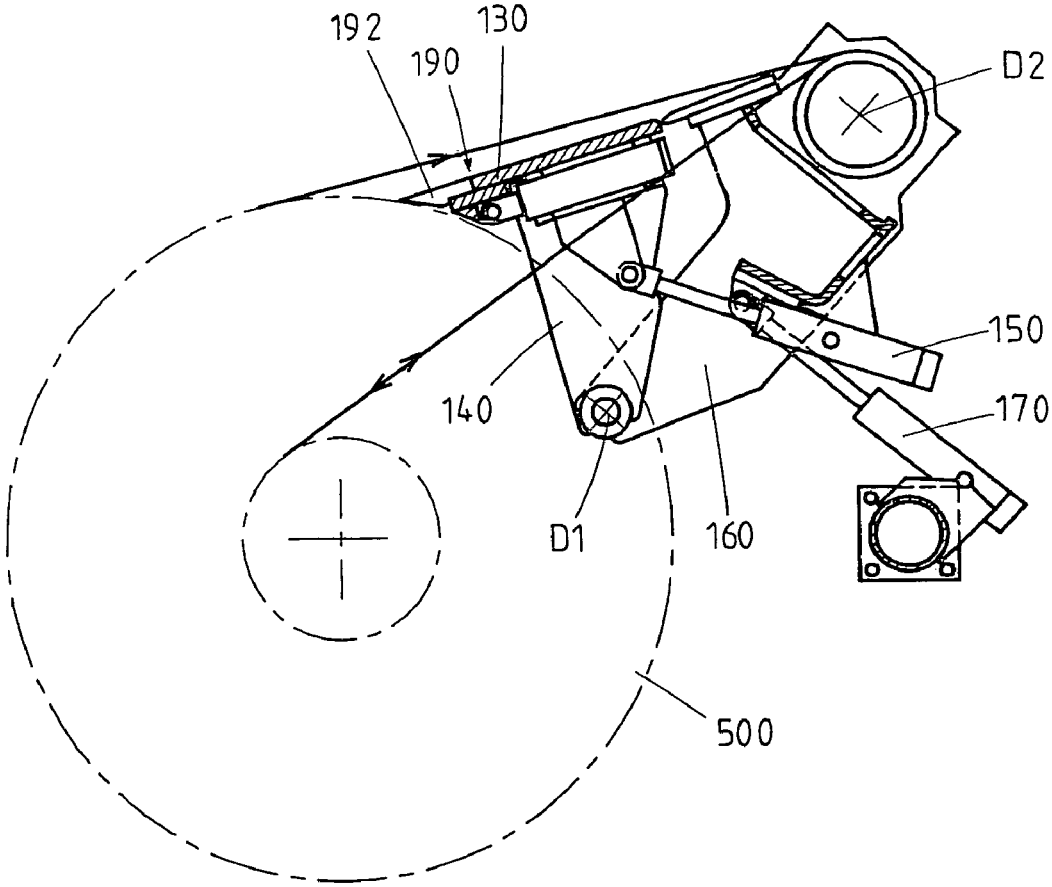
FIG. 4 shows the device of the invention in the position "coil opening".

FIG. 4 shows the device of the invention in the operating position "coil opening". To open the coil, the chisel 192 is pushed under a free end of the metal strip on the coil 500, while at the same time the coil is turned in such a way that the metal strip uncoils and is guided over the chisel and the first, second, and third guide tables in the direction of the arrow. As FIG. 10 shows, the device of the invention is suitable for very different coil sizes, i.e., coil diameters, because the tip of the chisel can be positioned accordingly by means of the actuators 150, 170, 180.

Figure 5:
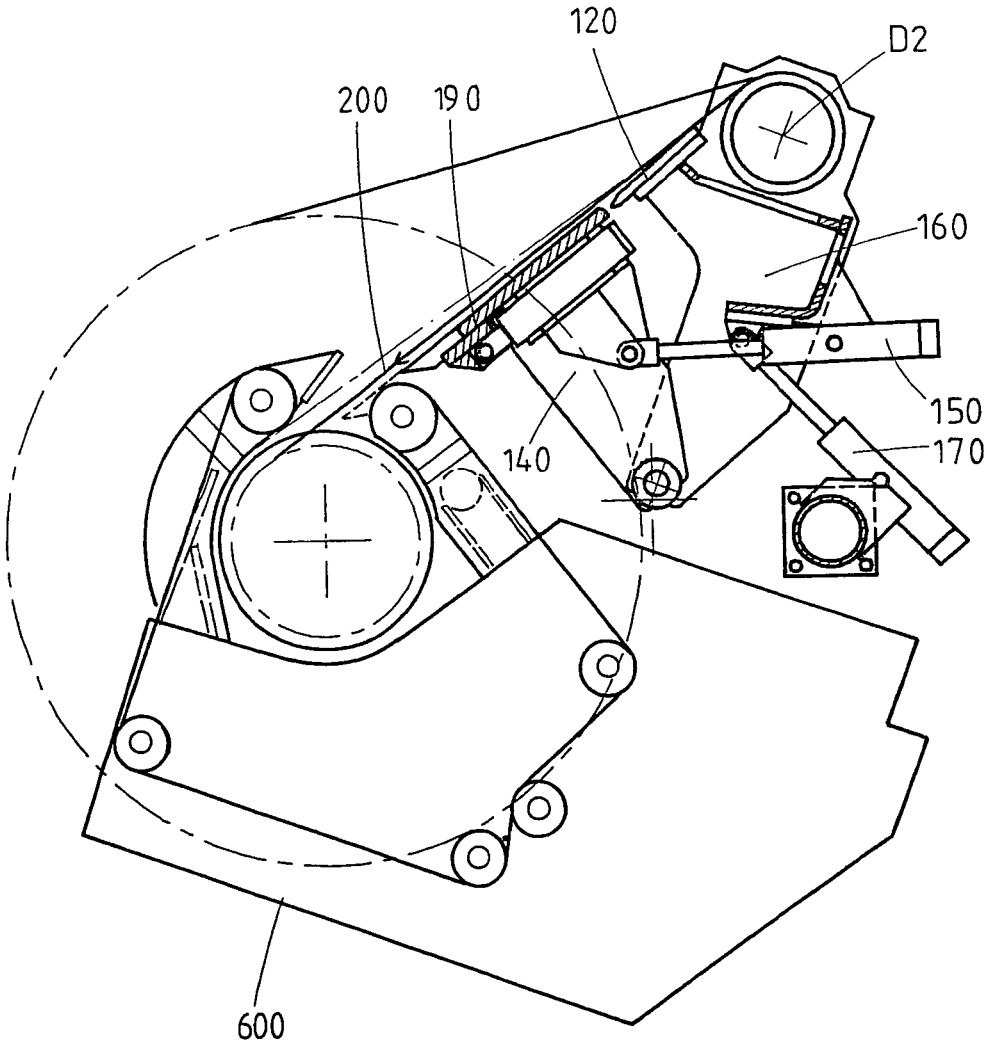
FIG. 5 shows the device in the position "belt wrapper".

FIG. 5 shows the use of the device of the invention for inserting the metal strip 200 in the direction of the arrow into a belt wrapper 600 as an alternative to inserting it into a clamping slot.

An advantageous feature is that all five of the aforementioned operating positions, namely, the parking position, clamping slot, strip guidance over the coil, coil opening, and belt wrapper, can be set by suitable control of the three actuators 150, 170, and 180.

Figure 6:
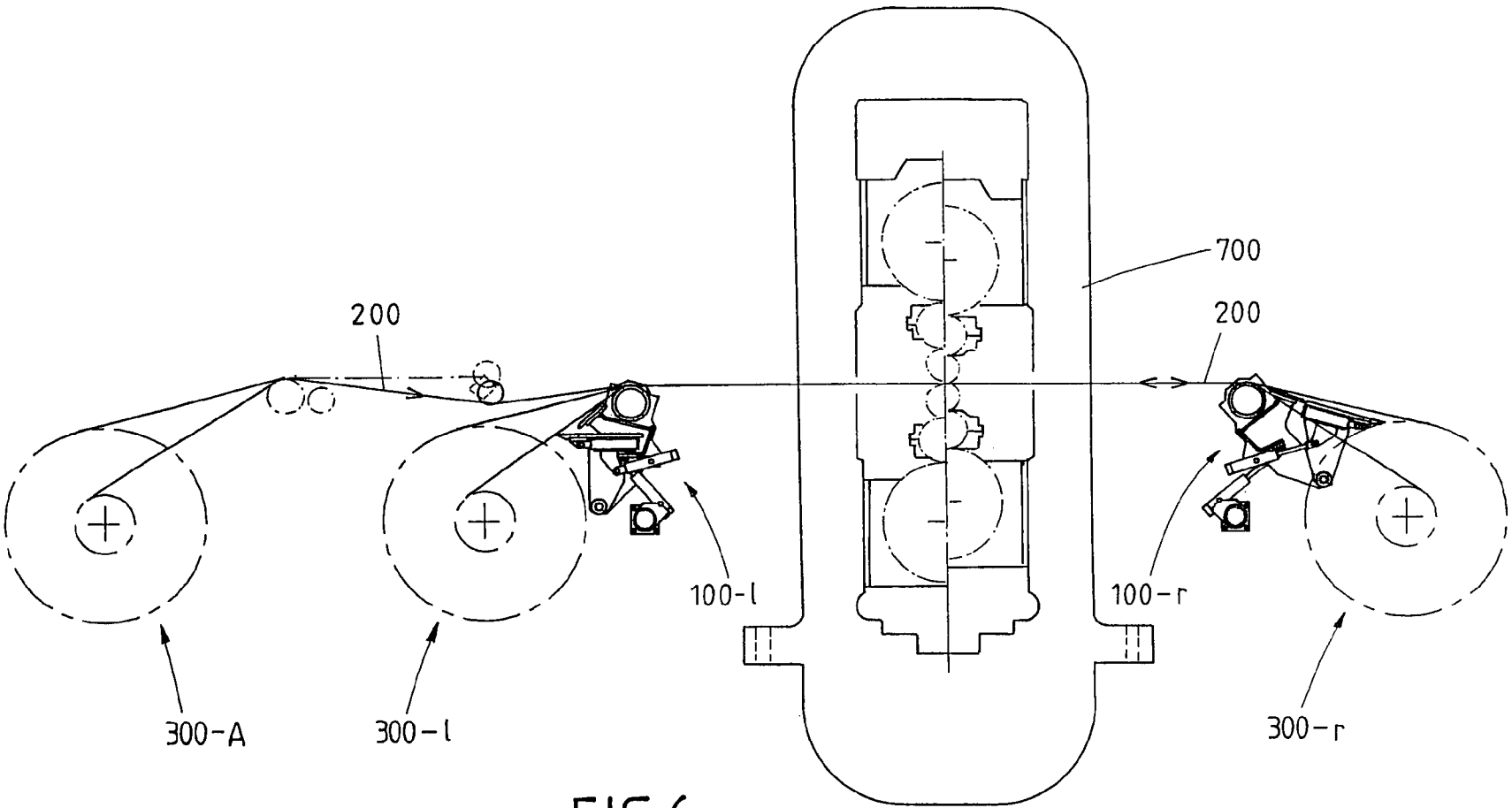
FIG. 6 shows the use for two of the devices of the invention on the left and right sides of a reversing mill between a left and right coiler.

FIG. 6 shows the use of two devices of the invention with the same design 100-*r* and 100-*l* in combination with a reversing mill 700. A right reversing coiler 300-*r* is installed on the right side of the reversing mill 700, and a left reversing coiler 300-*l* is installed on the left side of the reversing mill 700. On their sides facing the reversing mill 700, the reversing coilers 300-*r*, 300-*l* are each assigned a device of the invention 100-*r*, 100-*l* for guiding the metal strip 200. In addition, an unwinding coiler 300-A is installed on the outside to the left of the left reversing coiler 300-*l*.

At the beginning of the reversing operation, the metal strip 200 is first unwound from the unwinding coiler 300-A and introduced into the reversing mill 700. During this process, the metal strip must be guided over the left reversing coiler 300-*l*; for this purpose, the left device of the invention 100-*l* is moved into the operating position "strip guidance over the coil". After passing through the reversing mill 700, the metal strip 200 is then coiled by the right reversing coiler 300-*r*; for this purpose, it is advantageous for the right device of the invention 100-*r* to move first into the position "clamping slot" or, if the right reversing coiler 300-*r* is designed as a belt wrapper, into the position "belt wrapper".

The metal strip 200 is coiled onto the right coiler 300-*r* only until the left end of the metal strip 200 is located at the level of the left reversing coiler 300-*l*. The direction of rotation of the left and right reversing coilers 300-*l*, 300-*r* is then reversed, e.g., both counterclockwise. The right device of the invention 100-*r* then moves into the "parking position", and the left device 100-*l* then moves into the position "clamping slot" or "belt wrapper" in order to clamp the left end of the metal strip 200 on the left reversing coiler 300-*l*. After this has been accomplished, the device 100-*l* also moves into the parking position.

During the following reversing operation, the left and right ends of the metal strip 200 remain clamped on the left and right reversing coilers 300-*l*, 300-*r*, and the two devices 100-*l*, 100-*r* remain in the parking position.

The two devices 100-*l* and 100-*r* also remain in the "parking position" when, at the end of the reversing operation, the finish rolled coil is removed from the line, for it is only in the parking position that the devices 100-*r* and 100-*l* do not block the movement of the wound coil out of the line.

The above clearly shows the advantages when each individual device of the invention 100-*l*, 100-*r* is able to assume the greatest possible number of different operating states.

The invention claimed is:

1. A device (100) for guiding a metal strip (200) in the vicinity of a coiler (300), which comprises:

a first guide table (110);

a swivel frame (140) with a first end on which the swivel frame is rotatably supported about a first axis of rotation (D1) and with a second end, which is at the opposite end from the first end and on which the swivel frame (140) supports the first guide table (110); and a first actuator (150) for swiveling the swivel frame with the first guide table (110) about the first axis of rotation (D1);

wherein, in addition, a support frame (160) is provided, with a first end on which the support frame is rotatably supported about a second, fixed axis of rotation (D2) relative to a fixed structure (400) and supports a second guide table (120) and with a second end on which the support frame (160) is rotatably supported about the first axis of rotation (D1) and is connected with the first end of the swivel frame (140); and where a second actuator (170) is provided, which is rotatably supported on both the fixed structure (400) and the support frame (160) for swiveling the support frame about the second, fixed axis of rotation (D2).

2. A device (100) in accordance with claim 1, wherein the swivel frame (140) has a U-shaped design with a crosshead formed by the first guide table (110) and with two parallel legs, which are positioned on opposite ends of and transverse to the first guide table (110) and have, respectively, the first and second ends of the swivel frame.

3. A device (100) in accordance with claim 1, wherein the support frame (160) has a U-shaped design with a crosshead formed by the second guide table (120) and with two parallel legs, which are positioned on opposite ends of and transverse to the second guide table (120) and have respectively the first and second ends of the support frame (160).

4. A device (100) in accordance with claim 1, comprising a carriage (190), which comprises a chisel (192) and a third guide table (130), which ends flush with a surface of the chisel, such that the carriage (190) is displaceably supported on the swivel frame (140); and a third actuator (180), which is hinged on the swivel frame (140) and on the carriage (190) to allow linear displacement of the carriage relative to the swivel frame, so that surfaces of the second and third guide tables (120, 130) remain lying in one plane in each displaced position.

5. A device (100) in accordance with Claim 4, wherein the ends of the second and the third guide tables (120, 130) that face each other have a comb design and can be pushed together to mate with each other in comb fashion.

6. A device (100) in accordance with claim 1, wherein at least one of the actuators (150, 170, 180) is designed as a hydraulic cylinder.

7. A device (100) in accordance with claim 1, comprising a guide pulley (195) that is rotatably supported about the second axis of rotation (D2) for deflecting the metal strip (200) when the strip is being wound onto or unwound from the coiler (300).

8. A method for operating a device (100) in accordance with claim 1, wherein the device can be moved selectively into one of several operating positions.

* * * * *